US009354646B2

(12) United States Patent
Kim et al.

(10) Patent No.: US 9,354,646 B2
(45) Date of Patent: May 31, 2016

(54) INTERNAL VOLTAGE GENERATOR AND CONTACTLESS IC CARD INCLUDING THE SAME

(71) Applicant: Samsung Electronics Co., Ltd., Suwon-Si, Gyeonggi-Do (KR)

(72) Inventors: Jun-Ho Kim, Seongnam-si (KR); Il-Jong Song, Yongin-si (KR); Jong-Pil Cho, Hwaseong-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 113 days.

(21) Appl. No.: 14/198,803

(22) Filed: Mar. 6, 2014

(65) Prior Publication Data

US 2014/0266414 A1 Sep. 18, 2014

(30) Foreign Application Priority Data

Mar. 13, 2013 (KR) ..... 10-2013-0026433

(51) Int. Cl.

| | |
|---|---|
| ***G05F 1/10*** | (2006.01) |
| ***G05F 1/46*** | (2006.01) |
| ***G05F 1/563*** | (2006.01) |
| ***G05F 1/614*** | (2006.01) |

(52) U.S. Cl.

CPC ..... *G05F 1/468* (2013.01); *G05F 1/563* (2013.01); *G05F 1/614* (2013.01)

(58) Field of Classification Search

CPC ..... G06K 19/0723; G07F 7/1008; G06Q 20/341; G06Q 20/385

See application file for complete search history.

(56) References Cited

U.S. PATENT DOCUMENTS

| | | | | |
|---|---|---|---|---|
| 6,996,726 | B1 | 2/2006 | Den Besten et al. | |
| 7,141,939 | B2 | 11/2006 | Nagasawa et al. | |
| 2005/0040885 | A1 * | 2/2005 | Hayashi | G05F 3/30 327/543 |
| 2006/0085655 | A1 | 4/2006 | Sung et al. | |

FOREIGN PATENT DOCUMENTS

| | | | |
|---|---|---|---|
| JP | 2005216134 | A | 8/2005 |
| KR | 20050073636 | A | 7/2005 |
| WO | WO-2010051117 | A1 | 5/2010 |

* cited by examiner

*Primary Examiner* — Sibin Chen
(74) *Attorney, Agent, or Firm* — Harness, Dickey & Pierce

(57) ABSTRACT

A voltage generator of a contactless integrated circuit (IC) card includes a regulator configured to generate a first internal voltage based on an input voltage and a first reference voltage, the input voltage being received through an antenna of the contactless IC card. The voltage generator includes an internal voltage generator configured to generate a second internal voltage, the second internal voltage being used to operate an internal circuit of the contactless IC card. The voltage generator includes a reference voltage generator configured to generate a second reference voltage based on the first internal voltage, the second reference voltage being generated without regard to a fluctuation component of the first internal voltage. The voltage generator includes a switching unit configured to provide one of the first and second internal voltages as the first reference voltage in response to first and second switching control signals.

15 Claims, 14 Drawing Sheets

100b

500a

INTERNAL VOLTAGE GENERATOR AND CONTACTLESS IC CARD INCLUDING THE SAME

CROSS-REFERENCE TO RELATED APPLICATION(S)

This application claims priority under 35 U.S.C. §119 to Korean Patent Application No. 10-2013-0026433, filed on Mar. 13, 2013, in the Korean Intellectual Property Office (KIPO), the entire contents of which are incorporated herein by reference.

BACKGROUND

1. Technical Field

At least one exemplary embodiment relates generally to integrated circuit (IC) card. More particularly, at least one exemplary embodiment of inventive concepts relates to an internal voltage generator of a contactless IC card and/or a contactless IC card including the same.

2. Description of the Related Art

An IC card is a credit card-sized plastic card to which a thin semiconductor device is attached. Typically, an IC card provides a higher level of security than a conventional magnetic striped card and does not readily lose stored data. The IC card is generally a plastic card having the same thickness and size as a conventional magnetic card or a credit card. The IC card is usually formed as a type of a Chip-On-Board (COB) with a thickness of about 0.5 mm.

The IC cards are divided into two categories; contact IC cards and contactless IC cards. The contactless IC cards are further divided into Contactless IC Cards (CICC) and Remote Coupling Communication Cards (RCCC). For the CICC, a communication range is from 0 to 2 mm at a carrier frequency of 4.9157 MHz. For the RCCC, a communication range is from 0 to 10 cm, at a carrier frequency of 13.56 MHz.

The contactless cards are in accordance with the International Organization for Standardization (ISO) and the International Electro-technical Commission (IEC). For example, the ISO/IEC 10536 standard defines specifications for CICC, and the ISO/IEC 14443 standard defines specifications for certain mechanical characteristics of RCCC and protocols on a wireless frequency power, signal interface, initialization procedure and collision prevention techniques, etc. According to the ISO/IEC 14443 standard, the contactless IC card includes an Integrated Circuit (IC) for carrying out processing and/or memory functions.

SUMMARY

At least one exemplary embodiment provides an internal voltage generator of a contactless IC card, capable of mitigating (or alternatively, preventing) ripple phenomenon.

At least one exemplary embodiment provides a contactless IC card including the internal voltage generator.

According to at least one example embodiment, a voltage generator of a contactless integrated circuit (IC) card includes a regulator configured to generate a first internal voltage based on an input voltage and a first reference voltage, the input voltage being received through an antenna of the contactless IC card. The voltage generator includes an internal voltage generator configured to generate a second internal voltage, the second internal voltage being used to operate an internal circuit of the contactless IC card. The voltage generator includes a reference voltage generator configured to generate a second reference voltage based on the first internal voltage, the second reference voltage being generated without regard to a fluctuation component of the first internal voltage. The voltage generator includes a switching unit configured to provide one of the first and second internal voltages as the first reference voltage in response to first and second switching control signals, the first and second switching controls indicating an operation mode of the internal circuit.

According to at least one example embodiment, the voltage generator further includes a switching signal generator. The switching signal generator is configured to, in response to a mode signal indicating the operation mode, generate the first and second switching control signals, and control activation intervals of the first and second switching control signals, the operation mode being based on current consumed in the internal circuit.

According to at least one example embodiment, the activation intervals of the first and second switching control signals partially overlap. The switching unit includes a first switch connected between the internal voltage generator and the regulator, the first switch being configured to receive the first switching control signal. The switching unit includes a second switch connected between the reference voltage generator and the regulator, the second switch being configured to receive the second switching control signal.

According to at least one example embodiment, the operation mode includes first and second operation modes according to the current consumed in the internal circuit. A first current consumed in the first operation mode is less than a second current consumed in the second operation mode.

According to at least one example embodiment, the first internal voltage is applied as the first reference voltage in response to the first switching control signal in the first operation mode, and the second reference voltage is applied as the first reference voltage in response to the second switching control signal in the second operation mode.

According to at least one example embodiment, the internal circuit performs at least one encryption operation in the second operation mode.

According to at least one example embodiment, the reference voltage generator includes a filter configured to filter the fluctuation component of the first internal voltage to generate the first reference voltage.

According to at least one example embodiment, the filter is a low-pass filter.

According to at least one example embodiment, the reference voltage generator includes a constant voltage generator configured to remove the fluctuation component of the first internal voltage by generating a constant voltage having a fixed level as the first reference voltage.

According to at least one example embodiment, the regulator includes a first comparator configured to compare a voltage of a first node and the first reference voltage. The regulator includes a current source and a first resistor connected in series with the current source between the input voltage and a ground voltage, the first node being at a connection point between the first resistor and the current source. The regulator includes a first p-channel metal-oxide semiconductor (PMOS) transistor connected between the input voltage at a second node to which the first internal voltage is provided, the first PMOS transistor having a gate connected to an output of the first comparator.

According to at least one example embodiment, the internal voltage generator includes a second comparator configured to compare a voltage of a third node and a third reference voltage, the voltage of the third node being the first internal voltage divided by resistances of second and third resistors, the second and third resistors being connected in series between the second node and the ground voltage. The internal voltage generator includes a n-channel metal-oxide semiconductor (NMOS) transistor connected between the second node and the ground voltage, the NMOS transistor having a gate connected to an output of the second comparator. The internal voltage generator includes a second PMOS transistor connected between the second node and a fourth node, the second internal voltage being provided at the fourth node. The internal voltage generator includes a third comparator configured to compare a voltage of a fifth node and the third reference voltage, the voltage of the fifth node being the second internal voltage divided by resistances of fourth and fifth resistors, the fourth and fifth resistors being connected in series between the fourth node and the ground voltage.

According to at least one example embodiment, a contactless integrated circuit (IC) card, includes a voltage generator configured to generate a first internal voltage and a second internal voltage based on an input voltage received through an antenna of the contactless IC card, the second internal voltage having a level that is less than a level of the first internal voltage. The contactless IC card includes an internal circuit configured to receive the second internal voltage and operate according to the second internal voltage. The contactless IC includes a detector configured to detect a current consumed in the internal circuit and send a mode signal to the internal voltage generator based on the detected current. The internal voltage generator includes a regulator configured to generate the first internal voltage based on the input voltage and a first reference voltage, an internal voltage generator configured to generate the second internal voltage such that the second internal voltage is less than the first internal voltage, a reference voltage generator configured to generate a second reference voltage based on the first internal voltage. The second reference voltage may be generated without regard to a fluctuation component of the first internal voltage. The voltage generator includes a switching unit configured to apply one of the first and second internal voltages as the first reference voltage in response to first and second switching control signals, the first and second switching control signals being based on the mode signal, the mode signal indicating an operation mode of the internal circuit.

According to at least one example embodiment, the contactless IC card includes a demodulator configured to demodulate input data and send the demodulated input data to the internal circuit, the input data being received through the antenna. The contactless IC card includes a modulator configured to modulate output data from the internal circuit and send the modulated output data to the antenna. The operation mode includes a first operation mode in which the modulator and the demodulator operate and a second operation mode in which the internal circuit performs at least one encryption operation.

According to at least one example embodiment, a first current consumed in the first operation mode is less than a second current consumed in the second operation mode. The first internal voltage is used as the first reference voltage in response to the first switching control signal in the first operation mode. The second reference voltage is used as the first reference voltage in response to the second switching control signal in the second operation mode.

According to at least one example embodiment, the reference voltage generator includes a filter configured to filter the fluctuation component of the first internal voltage to generate the first reference voltage.

According to at least one example embodiment, a contactless integrated circuit (IC) card includes an encryption circuit configured to encrypt input data received by an antenna of the contactless IC card, and a current detector. The current detector is configured to detect an amount of current consumed by the encryption circuit, and output a mode signal based on the detected amount of current. The contactless IC card includes a voltage generator configured to generate a first voltage based on a reference voltage and an input voltage, the reference voltage being generated in response to the mode signal, the input voltage being received from the antenna. The voltage generator is configured to generate a second voltage based on the first voltage, the second voltage supplying the encryption circuit with power and being less than the first voltage.

According to at least one example embodiment, the mode signal indicates one of a first operation mode and a second operation mode of the encryption circuit, the first operation mode being a mode in which the encryption circuit is not performing an encryption operation on the input data, the second mode being a mode in which the encryption circuit is performing an encryption operation on the input data.

According to at least one example embodiment, the voltage generator is configured to use the first voltage as the reference voltage in first operation mode, and use a third voltage as the reference voltage in the second operation mode, the third voltage excluding a fluctuation component of the first voltage.

According to at least one example embodiment, the third voltage is one of a constant voltage and a filtered voltage, the constant and filtered voltages being derived from the first voltage.

According to at least one example embodiment, the contactless IC card further includes a clock generator configured to generate a clock signal based on the first and second voltages, the encryption circuit operating according to the clock signal, a frequency of the clock signal being based on a level of the first voltage.

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION OF EXEMPLARY EMBODIMENTS

Figure 1:
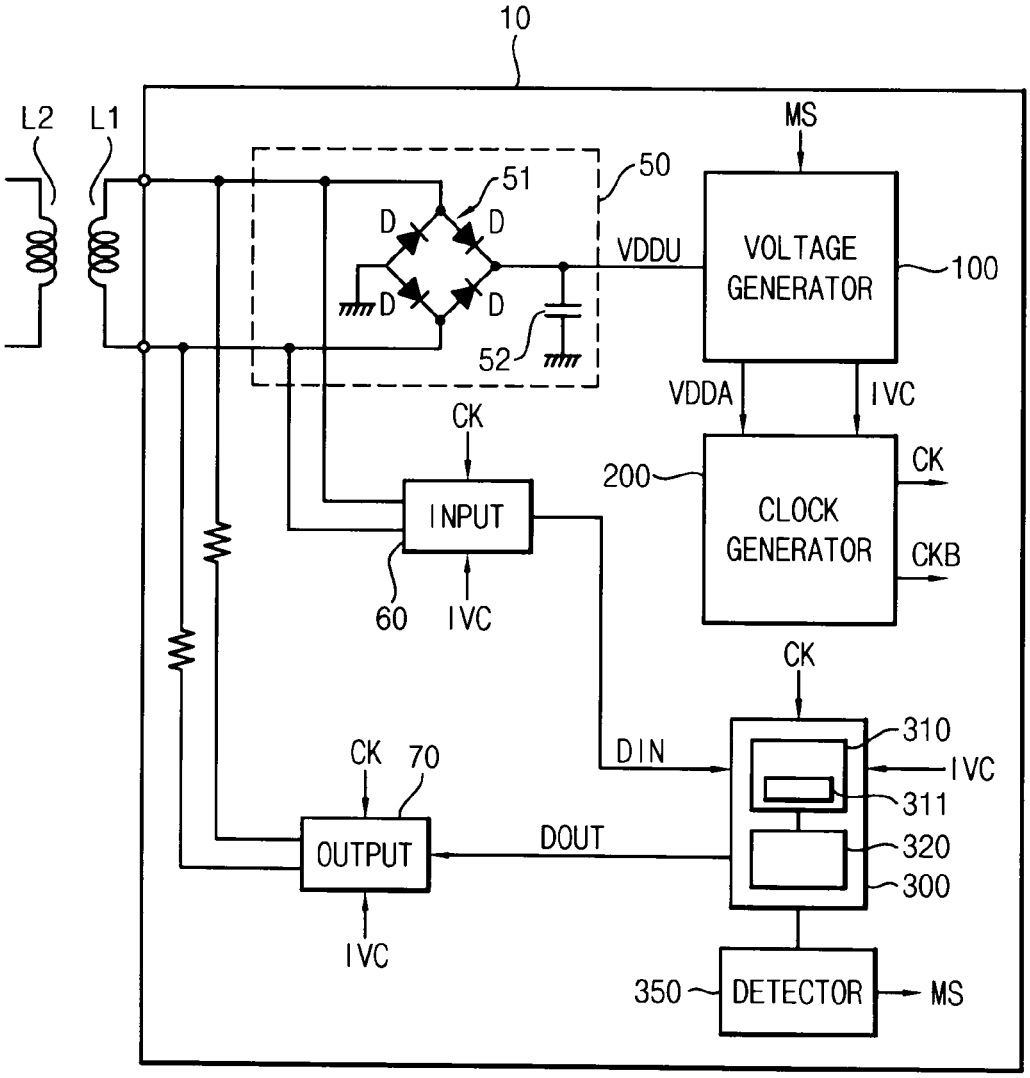
FIG. 1 is a block diagram illustrating a contactless integrated circuit (IC) card according to at least one example embodiment.

Various exemplary embodiments will be described more fully hereinafter with reference to the accompanying drawings, in which some exemplary embodiments are shown. Inventive concepts may, however, be embodied in many different forms and should not be construed as limited to the exemplary embodiments set forth herein. Rather, these exemplary embodiments are provided so that this description will be thorough and complete, and will fully convey the scope of inventive concepts to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of inventive concepts. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular exemplary embodiments only and is not intended to be limiting of inventive concepts. As used herein, the singular forms "a," "an" and "the" are intended to include the plural forms as well, unless the context clearly indicates otherwise. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which inventive concepts belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a contactless integrated circuit (IC) card according to at least one example embodiment.

In FIG. 1, antennas L1, L2 are also illustrated together with the contactless IC card 10 in FIG. 1. The antenna L1 may be referred to as a receiving coil and the antenna L2 may be referred to as a transmitting coil as part of a read/write device.

Referring to FIG. 1, the contactless IC card 10 is connected to the receiving coil L1, which is an antenna on the side of contactless IC card 10. The receiving coil L1 may be coil-shaped on the card and be made from copper film. The structure and the material of the receiving coil L1 are not limited to the description above. The contactless IC card 10 may include a rectifier circuit unit 50, a data receiving circuit 60, a data transmitting circuit 70, an internal voltage generator 100, a clock generator 200, an internal circuit (or an encryption circuit) 300 and a detector 350.

The rectifier circuit unit 50 may include a rectifier circuit 51 and a smoothing condenser 52. The rectifier circuit 51 may consist of four diodes forming a bridge, and the smoothing condenser 52 may be configured to smooth the rectified voltage of the rectifier circuit 51 to provide the smoothed voltage for an input voltage VDDU. The rectifier circuit 51 may rectify AC signal received by electromagnetic coupling of the receiving coil L1 and the transmitting coil L2 in the read/write device.

The data receiving circuit 60 may demodulate a data received from the read/write device to provide the demodulated data as an input data DIN for the internal circuit 300. In addition, the data transmitting circuit 70 may modulate an output data DOUT received from the internal circuit 300 to provide the modulated data for the read/write device through the receiving coil L1.

The internal voltage generator 100 may generate a first internal voltage VDDA and a second internal voltage IVC based on the input voltage VDDU. The level of the second internal voltage IVC may be lower than the level of the first internal voltage VDDA. The second internal voltage IVC is provided for the data receiving circuit 60, the data transmitting circuit 70 and the internal circuit 300 to be used as an operation voltage. In addition, the internal voltage generator 100 may select a reference voltage used for generating the first internal voltage VDDA in response to a mode signal MS that determines an operation mode of the contactless IC card 10 based on current consumed in the internal circuit 300.

The clock generator 200 may receive the first internal voltage VDDA and the second internal voltage IVC to generate a clock signal CK and an inverted clock signal CKB. The frequencies of the clock signal CK and the inverted clock signal CKB change according to the level of the first internal voltage VDDA. The phase of the inverted clock signal CKB may be opposite to the phase of the clock signal CK. The clock signal CK may be provided for the data receiving circuit 60, the data transmitting circuit 70 and the internal circuit. Accordingly, the clock signal CK may be used for operation sequence controls or signal/data transmissions.

The internal circuit 300 may include a logic circuit 310 and a non-volatile memory 320. The logic circuit 310 may include a random number generator 311. When the input data DIN is received or the output data DOUT is transmitted, the logic circuit 310 may use the random number generator 311 for encryption. For example, when the internal circuit 300 uses the random number generator 311 for encryption, the internal circuit consumes more current than a case when the internal circuit 300 does not use the random number generator 311. Therefore, the detector 310 detects the current consumed in the internal circuit 300 and provides the internal voltage generator 100 with the mode signal MS indicating whether the internal circuit 300 is performing an encryption operation. When the internal circuit 300 performs an encryption operation, a fluctuation component of the second internal voltage IVC may be transferred to the input voltage VDDU. The fluctuation component of the second internal voltage IVC may be caused by an abrupt increase of consumed current in the internal circuit 300 when the internal circuit 300 performs the encryption operation. The fluctuation component transferred to the input voltage VDDU causes load modulation, and may be transferred to a contactless IC card reader as a recognizable signal by the contactless IC card reader. When the fluctuation component is transferred to the contactless IC card reader as the recognizable signal, transmission errors may occur.

However, according to at least one example embodiment, the internal voltage generator 100 selects a reference voltage in response to the mode signal MS indicating whether the internal circuit 300 is performing an encryption operation, and thus inhibits (or alternatively, prevents) the fluctuation component from being transferred to the input voltage VDDU. Therefore, the internal voltage generator 100 may reduce (or alternatively, prevent) transmission errors that may occur when the internal circuit 300 performs an encryption operation.

Figure 2:
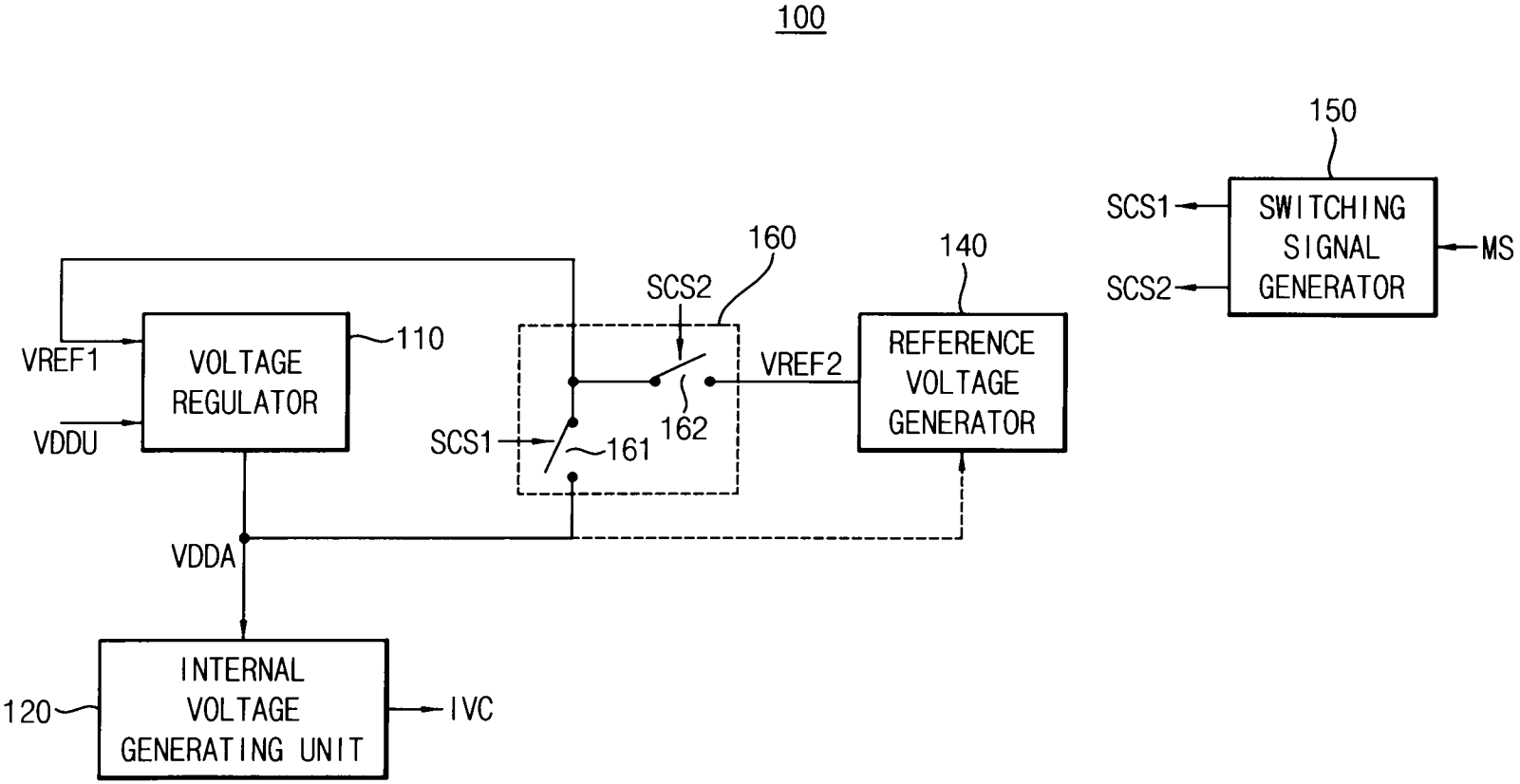
FIG. 2 is a block diagram illustrating an example of the internal voltage generator in FIG. 1 according to at least one example embodiment.

FIG. 2 is a block diagram illustrating an example of the internal voltage generator in FIG. 1 according to at least one example embodiment.

Referring to FIG. 2, the internal voltage generator 100 includes a regulator 110, an internal voltage generating unit 120, a reference voltage generator 140, a switching signal generator 150 and a switching unit 160.

The regulator 110 may generate the first internal voltage VDDA based on the input voltage VDDU received through the antenna L1 and a first reference voltage VREF1. The internal voltage generating unit 120 may generate the second internal voltage IVC, whose voltage level is lower than the level of the first internal voltage VDDA, based on the first internal voltage VDDA. The reference voltage generator 140 generates a second reference voltage VREF2 without regard to (or excluding) a fluctuation component of the first internal voltage VDDA, based on the first internal voltage VDDA. The switching signal generator 150 generates first and second switching control signals SCS1 and SCS2 according to the mode signal MS. In addition, the switching signal generator 150 controls activation intervals of the first and second switching control signals SCS1 and SCS2, respectively. The switching unit 160 provides the regulator 110 with one of the first internal voltage VDDA and the second reference voltage VREF2 as the first reference voltage VREF1 in response to the first and second switching control signals SCS1 and SCS2 (i.e., according to an operation mode).

The switching unit 160 may include first and second switches 161 and 162. The first switch 161 selectively provides the first internal voltage VDDA to the regulator 110 in response to the first switching control signal SCS1. The second switch 162 selectively provides the second reference voltage VREF2 to the regulator 110 in response to the second switching control signal SCS2.

For example, when the mode signal MS indicates a first operation mode in which the internal circuit 300 is not performing an encryption operation, the mode signal MS has a first (low) logic level, the first switching control signal SCS1 is activated, and the first switch 161 is connected in response to the first switching control signal SCS1. Then, the regulator 110 receives the first internal voltage VDDA as the first reference voltage VREF1 and performs a voltage regulation operation. For example, when the mode signal MS indicates a second operation mode in which the internal circuit 300 is performing encryption operation, the mode signal MS has a second (high) logic level, the second switching control signal SCS2 is activated, and the second switch 162 is connected in response to the second switching control signal SCS2. Then, the regulator 110 receives the second reference voltage VREF2 as the first reference voltage VREF1 and performs a voltage regulation operation. Here, a first current consumed in the first operation mode (i.e., when the encryption operation is not being performed) is less than a second current consumed in the second operation mode (when the encryption operation is being performed).

Figure 3:
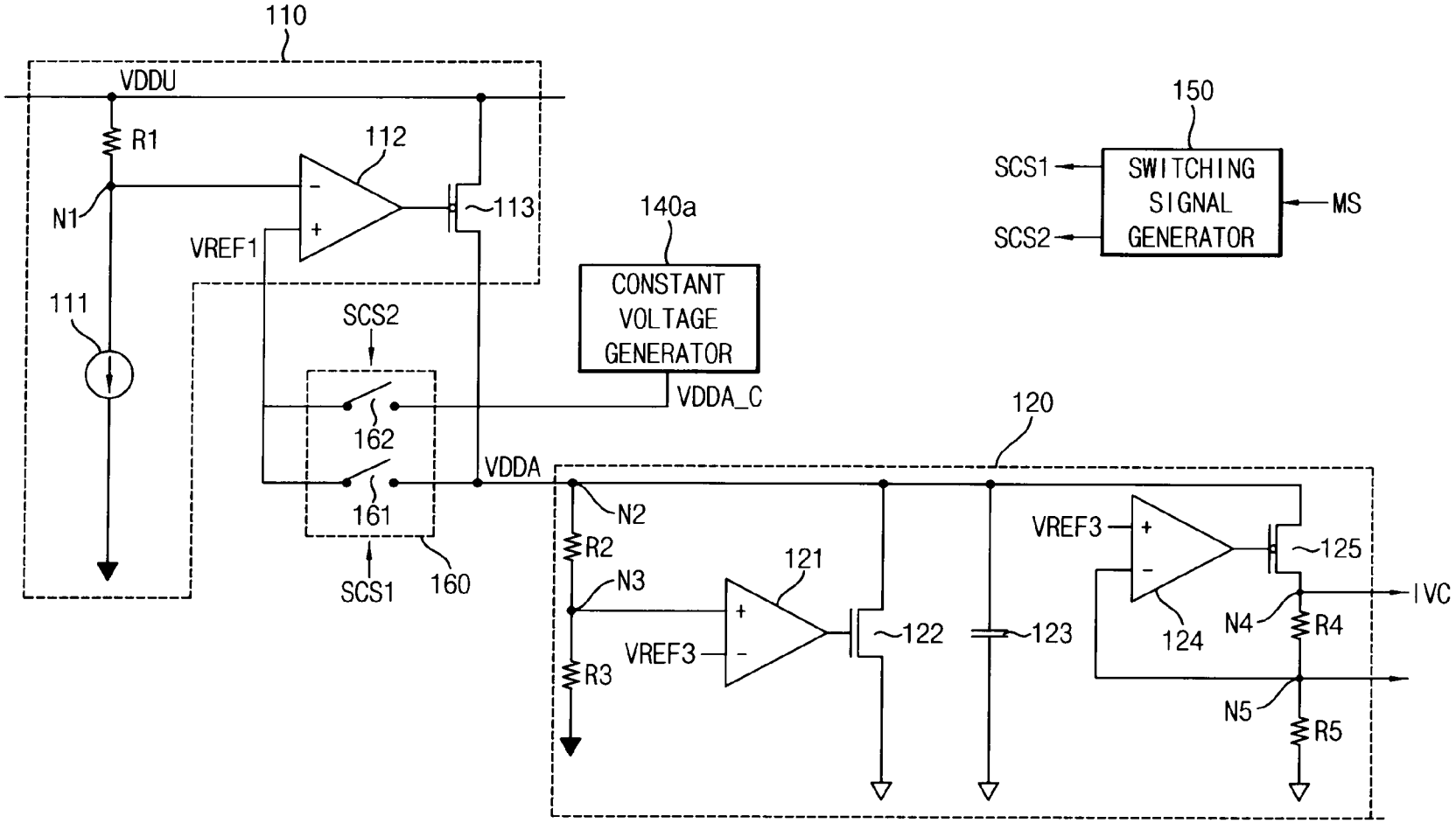
FIG. 3 is a circuit diagram illustrating an example of the internal voltage generator of FIG. 2 according to at least one example embodiment.

FIG. 3 is a circuit diagram illustrating an example of the internal voltage generator of FIG. 2 according to according to an operation mode.

In FIG. 3, an internal voltage generator 100*a* includes a constant voltage generator 140*a* as the reference voltage generator 140.

Referring to FIG. 3, the regulator 110 includes a current source 111, a first comparator 112, a first p-type metal-oxide semiconductor (PMOS) transistor 113 and a first resistor R1. The first comparator 112 compares a voltage of a first node N1 and the first reference voltage VREF1, and the first resistor R1 and the current source 111 are connected in series at the first node N1 between the input voltage VDDU and a ground voltage. The first PMOS transistor 113 may include a source connected to the input voltage VDDU, a drain connected to a second node N2, and a gate connected to an output of the first comparator 112. The first node N1 is connected to a negative input terminal of the first comparator 112 and the first reference voltage VREF1 is connected to a positive input terminal of the first comparator 112.

The first switch 161 is connected between the second node N2 and the positive input terminal of the first comparator 112, and the first switch 161 selectively provides the first internal voltage VDDA to the regulator 110 in response to the first switching control signal SCS1. The second switch 162 is connected between the constant voltage generator 140*a* and the positive input terminal of the first comparator 112, and the second switch 162 selectively provides a constant voltage VDDA_C having fixed level to the regulator 110 in response to the second switching control signal SCS2. The fixed level of the constant voltage VDDA_C may be the same as a level of the first interval voltage VDDA when the first interval voltage VDDA does not have the fluctuation component.

The internal voltage generating unit 120 may include resistors R2 and R3, a second comparator 121, an n-type metal-oxide semiconductor (NMOS) transistor 122, a capacitor 123, a third comparator 124, a PMOS transistor 125 and resistors R4 and R5. The resistors R2 and R3 are connected in series between the second node N2 and the ground voltage. A positive input of the second comparator 121 may be connected to the third node N3, and a negative input of the second comparator 121 may be connected to a third reference voltage VREF3. A drain of the NMOS transistor 122 may be connected to the second node N2 to receive the first internal voltage VDDA, and a gate of the NMOS transistor 122 may be connected to the output of the second comparator 121. A source of the NMOS transistor 122 may be connected to the ground voltage. The capacitor 123 may be connected between the second node N1 and the ground voltage to be charged by the first internal voltage VDDA. The PMOS transistor 125 may have a source connected to the second node N2, a drain connected to a fourth node N4, and a gate connected to an output of the third comparator 124. The second internal voltage IVC is provided from the fourth node N4. The resistors R4 and R5 are connected in series between the fourth node N4 and the ground voltage. The resistors R4 and R5 are connected to each other at a fifth node N5. A positive input of the third comparator 124 is connected to the third reference voltage VREF3 and a negative input of the third comparator 124 is connected to the fifth node N5.

The NMOS transistor 122 is turned on and reduces some portion of the first internal voltage VDDA in response to the output of the second comparator 121 when the level of the first interval voltage VDDA rises excessively. The NMOS transistor 122 is turned off and closes a path to the ground in response to the output of the second comparator 121 when the level of the first interval voltage VDDA drops excessively. When the internal circuit 300 is in normal operation and consumed current in the internal circuit 300 is relatively small, the NMOS transistor is turned on. When the internal circuit 300 performs an encryption operation and consumed current in the internal circuit 300 is relatively high, the NMOS transistor is turned off.

When the first internal voltage VDDA is increased above a desired threshold, the NMOS transistor 122 may be turned on in response to the output of the second comparator 121, which reduces a certain level of the first internal voltage VDDA to the ground voltage. When the first internal voltage VDDA is below a desired threshold, the NMOS transistor 122 may be turned off in response to the output of the second comparator 121, which blocks off a path to the ground voltage. In other words, when the current consumed in the logic circuit 310 of FIG. 1 is relatively small during the normal operation of the logic circuit 310, the NMOS transistor 122 may be turned on and the path to the ground voltage may be connected. When the current consumed in the logic circuit 310 is relatively large during the encryption operation of the logic circuit 310, the NMOS transistor 122 may be turned off and the path to the ground voltage may be disconnected.

Therefore, even when ripple phenomenon occurs (in which a level of the second internal voltage IVC rapidly decreases because the internal circuit 300 is performing encryption operation), the constant voltage generator 140*a* may provide the first comparator 112 with the constant voltage VDDA_C as the first reference voltage VREF1, which is not influenced by the ripple phenomenon. Therefore, the internal voltage generator 100*a* may reduce (or alternatively, prevent) transmission errors that may occur when the internal circuit 300 performs an encryption operation.

Figure 4:
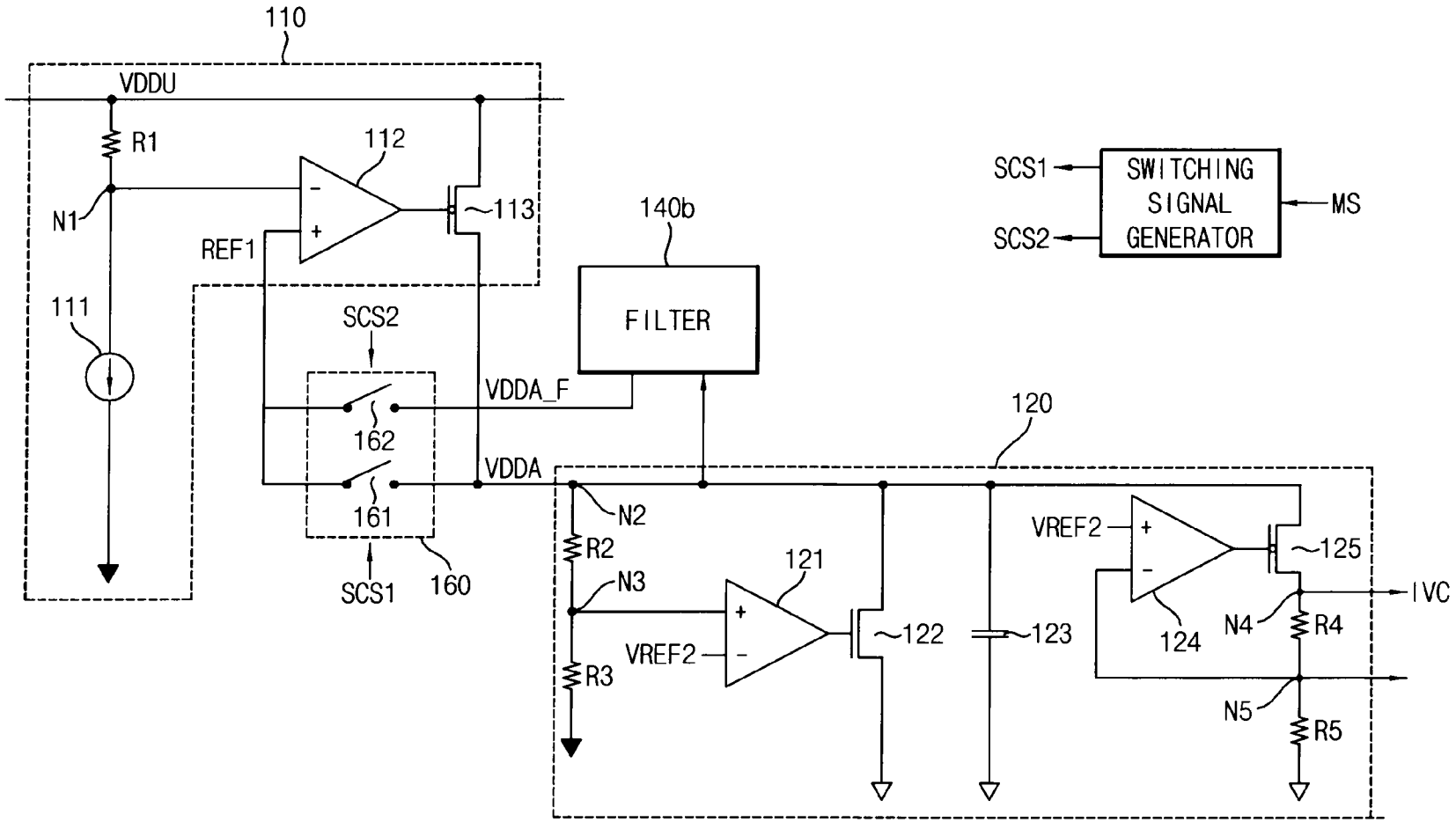
FIG. 4 is a circuit diagram illustrating another example of the internal voltage generator of FIG. 2 according to at least one example embodiment.

FIG. 4 is a circuit diagram illustrating another example of the internal voltage generator of FIG. 2 according to as the first reference voltage VREF1.

In FIG. 4, an internal voltage generator 100*a* includes a filter 140*b* as the reference voltage generator 140.

Referring to FIG. 4, the internal voltage generator 100*b* may include the filter 140*b* instead of the constant voltage generator 140*a* in FIG. 3. The filter 140*b* may be implemented with a low-pass filter. The filter 140*b* may filter the fluctuation component of the first internal voltage VDDA to provide a filtered voltage VDDA_F even when the ripple phenomenon occurs (in which a level of the second internal voltage IVC rapidly decreases because the internal circuit 300 is performing an encryption operation). The second switch 162 may provide the first comparator 112 with the filtered voltage VDDA_F as the first reference voltage VREF1 in the second operation mode. Therefore, the internal voltage generator 100*b* may reduce (or alternatively, prevent) transmission errors that may occur when the internal circuit 300 performs an encryption operation. In addition, the level of the input voltage VDDU decreases as the level of the first internal voltage VDDA decreases in the internal voltage generator 100*b*. Therefore, the internal voltage generator 100*b* may perform flexible power supply operation according to the consumed current in the internal circuit 300.

Figure 5:
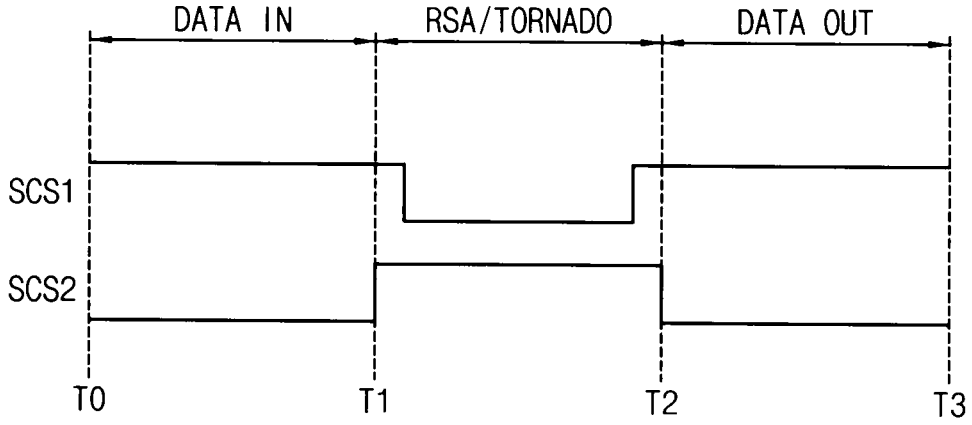
FIG. 5 illustrates the first and second switching control signals according to the operation mode of the contactless IC card of FIG. 1.

FIG. 5 illustrates the first and second switching control signals according to the operation mode of the contactless IC card of FIG. 1.

Referring to FIGS. 1 through 5, when data is inputted through the antenna L1 during an interval T0~T1, the demodulator 60 demodulates the input data and the internal circuit 300 does not perform an encryption operation. In this case, the internal circuit 300 operates in the first operation mode, the first switching signal SCS1 is activated, and the first internal voltage VDDA is provided as the first reference voltage VREF1 of the regulator 110. When the internal circuit 300 performs an encryption operation, such as an RSA or TORNADO encryption, on the input data or data to be outputted during an interval T1~T2, the internal circuit 300 operates in the second operation mode. In this case, the second switching signal SCS2 is activated, and the constant voltage VDDA_C or the filtered voltage VDDA_F is provided as the first reference voltage VREF1 of the regulator 110. During an interval T2~T3, the modulator 70 modulates the data to be outputted and the internal circuit 300 does not perform an encryption operation. In this case, the internal circuit 300 operates in the first operation mode, the first switching signal SCS1 is activated, and the first internal voltage VDDA is provided as the first reference voltage VREF1 of the regulator 110. As illustrated in FIG. 5, the first and second switching control signals SCS1 and SCS2 are partially overlapped in rising and falling edges with respect to each other.

Figure 6A:
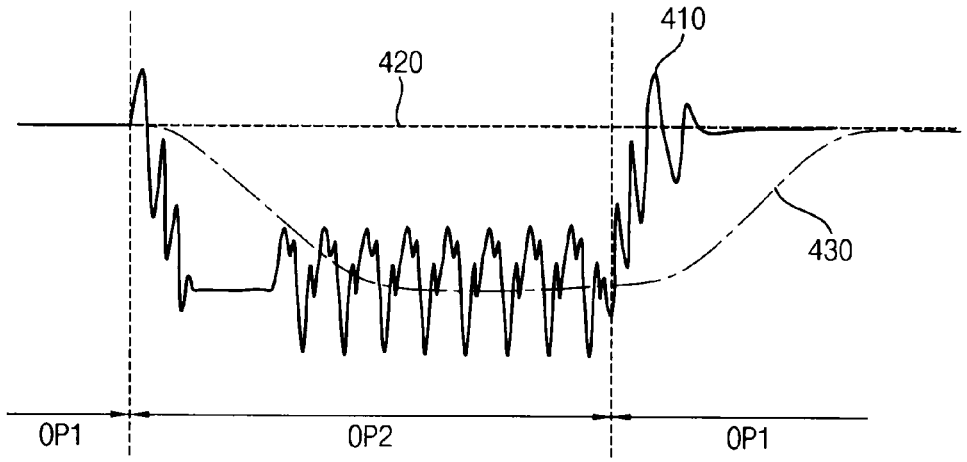
FIG. 6A is a waveform illustrating an example of the first reference voltage of the internal voltage generator according to at least one example embodiment.

FIG. 6A is a waveform illustrating an example of the first reference voltage of the internal voltage generator according to as the first reference voltage VREF1.

In FIG. 6A, a reference numeral 410 denotes a first case when the ripple phenomenon is not removed from the second internal voltage IVC, a reference numeral 420 denotes a second case when the internal voltage generator 100*a* of FIG. 3 is employed and a reference numeral 430 denotes a third case when the internal voltage generator 100*b* of FIG. 4 is employed.

Referring to FIG. 6A, when the first internal voltage VDDA having a fluctuation component of the second internal voltage IVC is used as a reference voltage of the regulator 110, it is noted that the input voltage VDDU has heavy ripples. As is noted by the reference numeral 420, when the internal voltage generator 100*a* of FIG. 3 is employed, the ripples are inhibited (or alternatively, prevented) from being transferred to the input voltage VDDU because the first reference voltage VREF1 has a fixed level. As is noted by the reference numeral 430, when the internal voltage generator 100*b* of FIG. 3 is employed, the ripples are inhibited (or alternatively, prevented) from being transferred to the input voltage VDDU because the first reference voltage VREF1 does not include the fluctuation component.

Figure 6B:
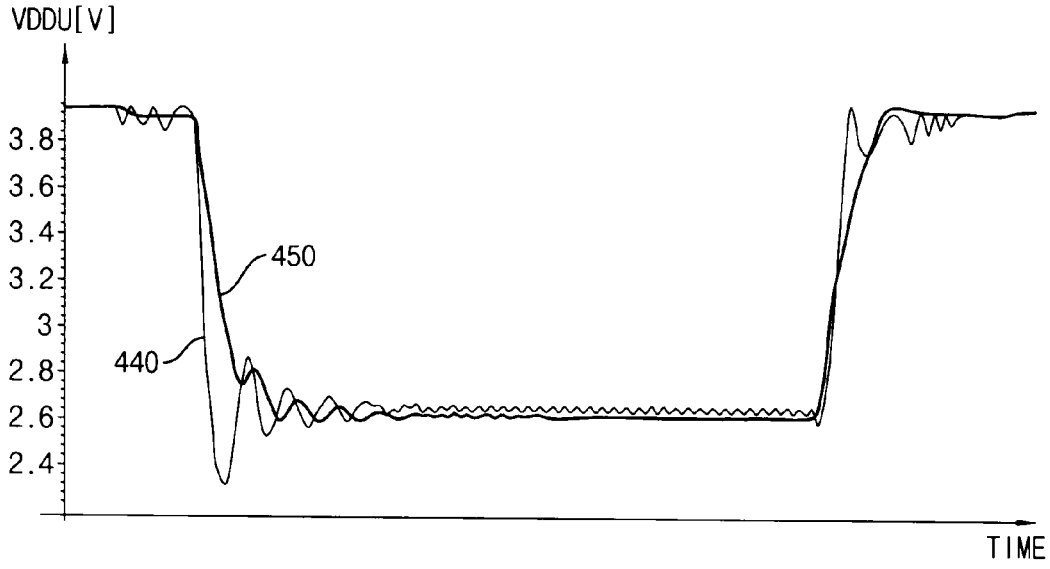
FIG. 6B is a waveform illustrating an example of the input voltage of the internal voltage generator according to v.

FIG. 6B is a waveform illustrating an example of the input voltage of the internal voltage generator according to at least one example embodiment.

In FIG. 6B, a reference numeral 450 denotes a first case when the ripple is not removed from the second internal voltage IVC, and a reference numeral 460 denotes a second case when the internal voltage generator 100*a* of FIG. 3 or the internal voltage generator 100*b* of FIG. 4 is employed.

Referring to FIG. 6B, when the first internal voltage VDDA having a fluctuation component of the second internal voltage IVC is used as a reference voltage of the regulator 110, it is noted that the input voltage VDDU has heavy ripples. As is noted by the reference numeral 450, when the first reference voltage VREF1 is selectively provided to the regulator 110 according to the operation mode, the ripples are inhibited (or alternatively, prevented) from being transferred to the input voltage VDDU because the first reference voltage VREF1 does not include the ripples. Therefore, the internal voltage generator 100 may reduce (or alternatively, prevent) transmission errors that may occur when the internal circuit 300 performs an encryption operation.

Figure 7:
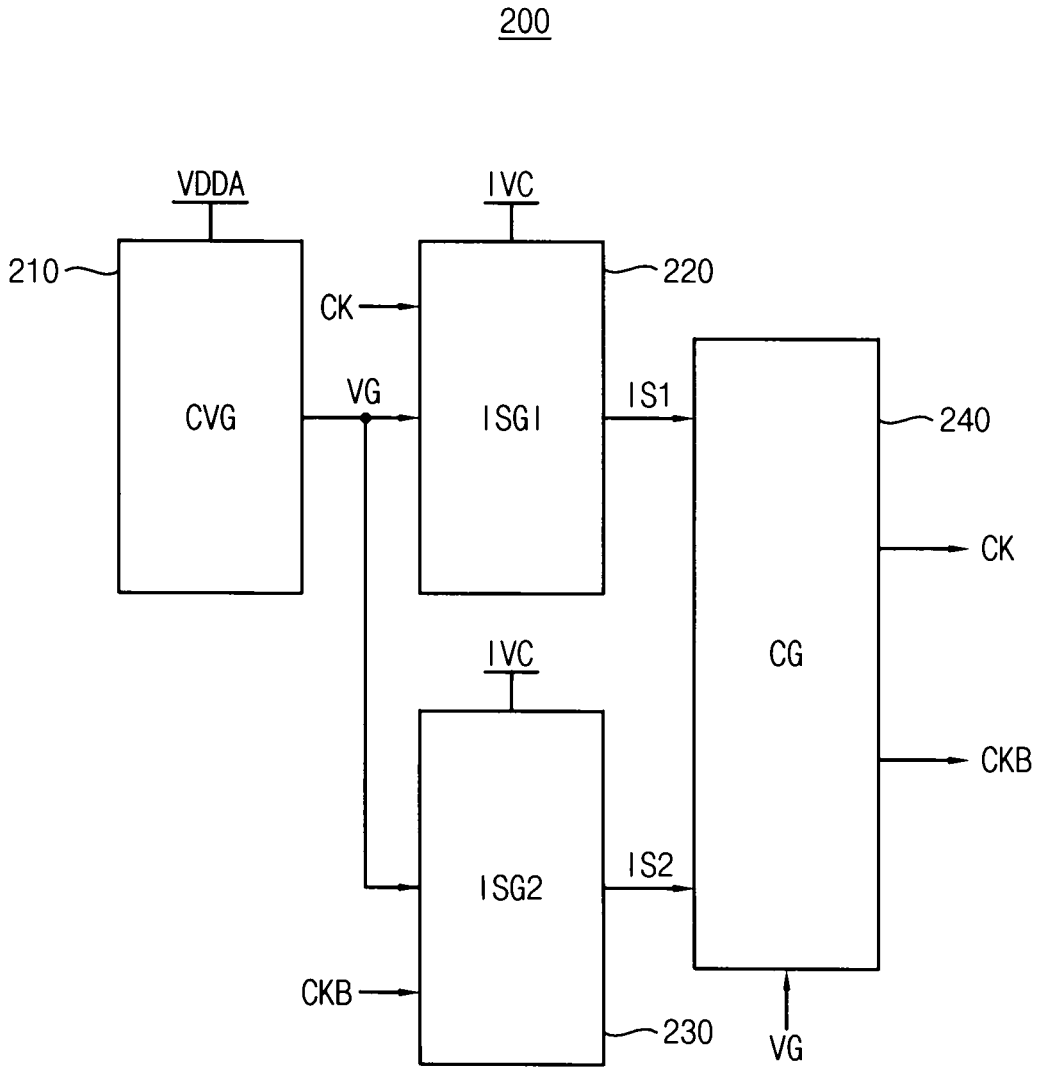
FIG. 7 is a block diagram illustrating an example of the clock generator in FIG. 1 according to at least one example embodiment.

FIG. 7 is a block diagram illustrating an example of the clock generator in FIG. 1 according to some exemplary embodiments.

Referring to FIG. 7, the clock generator 200 includes a control voltage generating unit 210, a first internal signal generating unit 220, a second internal signal generating unit 230 and a clock generating unit 240.

The control voltage generating unit 210 may receive the first internal voltage VDDA to generate a control voltage VG. The level of the control voltage VG may be lower than the level of the first internal voltage VDDA. The first internal signal generating unit 220 may receive the second internal voltage IVC and the control voltage VG. The first internal signal generating unit 220 may provide a first internal signal IS1 in response to the clock signal CK. The first internal signal IS1 may have the level of the second internal voltage IVC during a first half period of the clock signal CK. The second internal signal generating unit 230 may receive the second internal voltage IVC and the control voltage VG. The second internal signal generating unit 230 may provide a second internal signal IS2 in response to the inverted clock signal CKB. The second internal signal IS2 may have the level of the second internal voltage IVC during a second half period of the clock signal CK. The clock generating unit 240 may generate the clock signal CK and the inverted clock signal CKB in response to the first internal signal IS1 and the second internal signal IS2.

Figure 8:
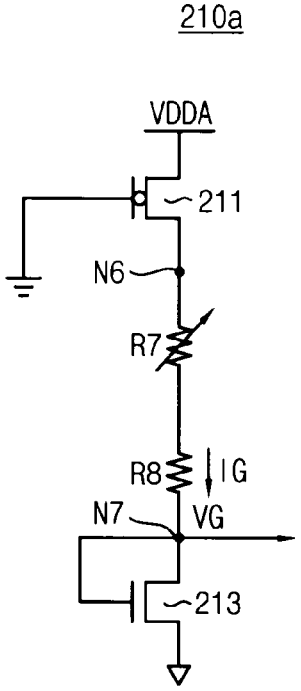
FIG. 8 is a circuit diagram illustrating an example of the control voltage generating unit in FIG. 7 according to at least one example embodiment.

FIG. 8 is a circuit diagram illustrating an example of the control voltage generating unit in FIG. 7 according to at least one example embodiment.

Referring to FIG. 7, a control voltage generating unit 210*a* includes a PMOS transistor 211, a variable resistor R7, a resistor R8 and NMOS transistor 213. The PMOS transistor 211 may include a source connected to the first internal voltage VDDA, a drain connected to a node N6, and a gate connected to the ground voltage. The variable resistor R7 and the resistor R8 are connected in series between the node N6 and a node N7. The NMOS transistor 213 may include a drain and a gate, which are connected to the node N7, and a source connected to the ground voltage. Since the gate and the drain are connected to each other, the NMOS transistor 213 is a diode-connected transistor. Therefore, the current to the ground voltage does not flow. Considering a current IG flowing through the variable resistor R7 and the resistor R8, the relationship between the current IG, resistors R7 and R8, the first internal voltage VDDA and the control voltage VG may represented as the following [Expression 1].

$$IG=(VDDA-VG)/(R7+R8) \quad \text{[Expression 1]}$$

Figure 9:
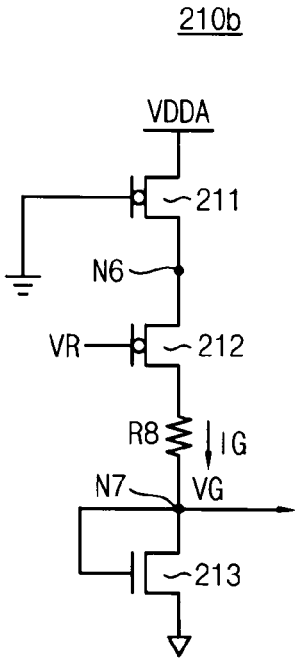
FIG. 9 is a circuit diagram illustrating another example of the control voltage generating unit in FIG. 7 according to at least one example embodiment.

FIG. 9 is a circuit diagram illustrating another example of the control voltage generating unit in FIG. 7 according to at least one example embodiment.

Referring to FIG. 9, a control voltage generating unit 210*b* includes a PMOS transistor 212 that is substituted for the variable resistor R7 in FIG. 8. Bias voltage VR is applied to the gate of the PMOS transistor 212. The PMOS transistor 212 operates like a variable resistor according to the bias voltage VR. When the resistance of the PMOS transistor 212 is substantially equal to the resistor R7, it is possible to apply [Expression 1] to FIG. 9.

Figure 10:
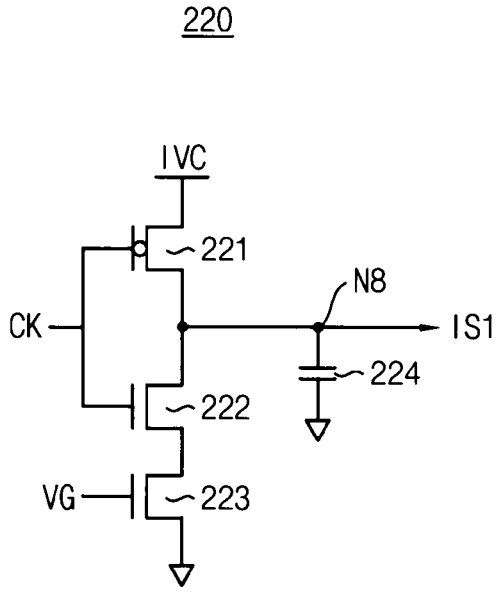
FIG. 10 is a circuit diagram illustrating an example of the first internal signal generating unit in FIG. 7 according to at least one example embodiment.

FIG. 10 is a circuit diagram illustrating an example of the first internal signal generating unit in FIG. 7 according to at least one example embodiment.

Referring to FIG. 10, the first internal signal generating unit 220 includes a PMOS transistor 221, NMOS transistors 222, 223, and a capacitor 224. The PMOS transistor 221 may have a source connected to the second internal voltage IVC and a drain connected to a drain of the NMOS transistor 222 at a node N8. The clock signal CK is provided to the gates of the PMOS transistor 221 and NMOS transistor 222. The drain of the NMOS transistor 223 is connected to the source of the NMOS transistor 222. The source of the NMOS transistor 223 is connected to the ground voltage. The control voltage VG is provided to the gate of the NMOS transistor 223. The capacitor 224 is connected between the node N8 and the ground voltage to store the voltage of node N8. The first internal signal IS1 is provided at the node N8.

Figure 11:
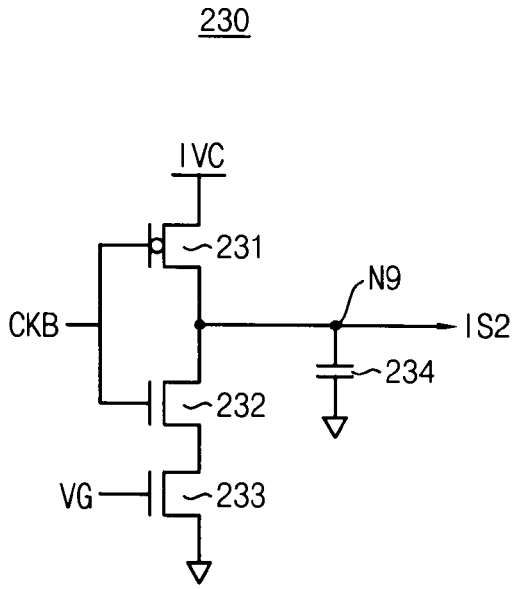
FIG. 11 is a circuit diagram illustrating an example of the second internal signal generating unit in FIG. 7 according to at least one example embodiment.

FIG. 11 is a circuit diagram illustrating an example of the second internal signal generating unit in FIG. 7 according to at least one example embodiment.

Referring to FIG. 11, the second internal signal generating unit 230 includes a PMOS transistor 231, NMOS transistors 232, 233, and a capacitor 234. The PMOS transistor 231 may have a source connected to the second internal voltage IVC, a drain connected to a drain of the NMOS transistor 232 at a node N9. The inverted clock signal CKB is provided to the gates of the PMOS transistor 231 and NMOS transistor 232. The drain of the NMOS transistor 233 is connected to the source of the NMOS transistor 232. The source of the NMOS transistor 233 is connected to the ground voltage. The control voltage VG is provided to the gate of the NMOS transistor 233. The capacitor 234 is connected between the node N9 and the ground voltage to store the voltage of the node N9. The second internal signal IS2 is provided at the node N9. The capacitors 224, 234 may have a substantially same capacitance.

Figure 12:
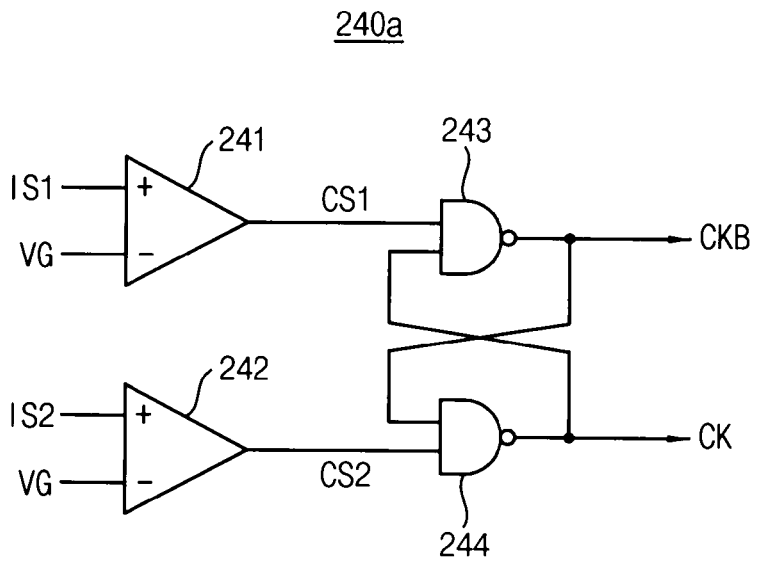
FIG. 12 is a circuit diagram illustrating an example of the clock generating unit in FIG. 7 according to v.

FIG. 12 is a circuit diagram illustrating an example of the clock generating unit in FIG. 7 according to at least one example embodiment.

Referring to FIG. 12, a clock generating unit 240*a* includes comparators 241, 242 and NAND gates 243, 244. The first internal signal IS1 is provided to a positive input of the comparator 241 and the control voltage VG is provided to a negative input of the comparator 241. The comparator 241 outputs a first comparison signal CS1. Since the level of the first internal signal IS1 is higher than the level of the control voltage VG, the first comparison signal CS1 has a logic-high level. The second internal signal IS2 is provided to a positive input of the comparator 242 and a control voltage VG is provided to a negative input of the comparator 242. The comparator 242 outputs a second comparison signal CS2. Since the level of the second internal signal IS2 is higher than the level of the control voltage VG, the second comparison signal CS2 has a logic-high level. The NAND gate 243 performs a NAND operation with respect to the first comparison signal CS 1 and the clock signal CK to output the inverted clock signal CKB. The NAND gate 244 performs NAND operation with respect to the second comparison signal CS2 and the inverted clock signal CKB to output the clock signal CK. As a result, the clock signal CK and the inverted clock signal CKB may have opposite phases.

Figure 13:
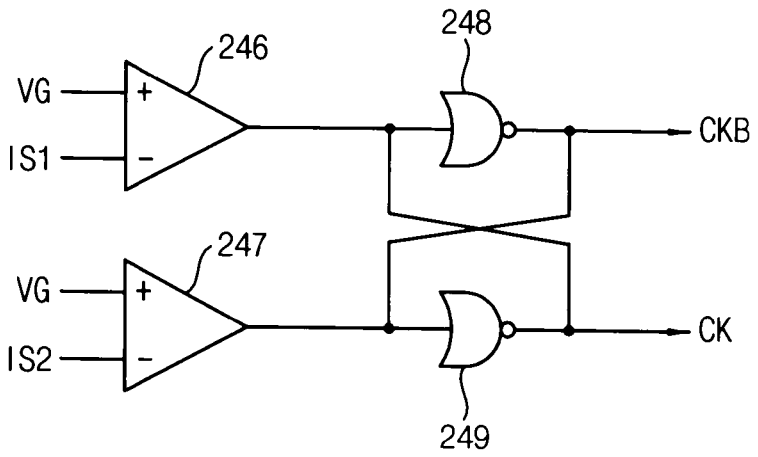
FIG. 13 is a circuit diagram illustrating another example of the clock generating unit in FIG. 7 according to at least one example embodiment.

FIG. 13 is a circuit diagram illustrating another example of the clock generating unit in FIG. 7 according to at least one example embodiment.

Referring to FIG. 13, a clock generating unit 240*b* includes comparators 246, 247 and NOR gates 248, 249. The first internal signal IS1 is provided to a negative input of the comparator 246 and the control voltage VG is provided to a positive input of the comparator 246. The comparator 246 outputs a first comparison signal CS1. Since the level of the first internal signal IS1 is higher than the level of the control voltage VG, the first comparison signal CS 1 has a logic-low level. The second internal signal IS2 is provided to a negative input of the comparator 247 and the control voltage VG is provided to a positive input of the comparator 247. The comparator 247 outputs the second comparison signal CS2. Since the level of the second internal signal IS2 is higher than the level of the control voltage VG, the second comparison signal CS2 has a logic-low level. The NOR gate 248 performs NOR operation with respect to the first comparison signal CS 1 and the clock signal CK to output the inverted clock signal CKB. The NOR gate 249 performs a NOR operation with respect to the second comparison signal CS2 and the inverted clock signal CKB to output the clock signal CK. As a result, the clock signal CK and the inverted clock signal CKB may have opposite phases.

Therefore, with reference to FIGS. 7-13, the relationship between the period T of the clock signal CK, the current IG and the capacitance C may be represented as the following [Expression 2].

$$T=(IVC-VG)*C/IG \quad \text{[Expression 2]}$$

Using [Expression 1] for IG, [Expression 2] can be represented in another form as the following [Expression 3].

$$T=(IVC-VG)*(R7+R8)*C/(VDDA-VG) \quad \text{[Expression 3]}$$

Therefore, the period of the clock signal CK is increased as the level of the first internal voltage VDDA is decreased. In addition, the period T of the clock signal CK may be adjusted by using the variable resistor R7. As a result, the clock generating unit 240 may generate the clock signal CK, whose frequency changes according to the first internal voltage VDDA.

Referring to FIGS. 1 to 13, operation of the contactless IC card according to at least one example embodiment will be described below.

When operating in a first mode (e.g., a normal mode), the internal circuit 300 may bear the consumed current, which has the level of the first internal voltage VDDA based on the input voltage VDDU. Then, the first switch 161 is connected in response to the first switching control signal SCS1 based on the mode signal MS. The first internal voltage VDDA is used as the first reference voltage VREF1 of the regulator 110.

When performing operations such as encryption operation (in which current consumption increases), the level of the second internal voltage IVC decreases rapidly and causes ripples in the second internal voltage IVC. When the ripples occur, a transmission error may occur due to the transferred ripples. For reducing (or alternatively, preventing) such transmission errors for an encryption operation, the second switch 162 is connected in response to the second switching control signal SCS2 based on the mode signal MS.

Figure 14:
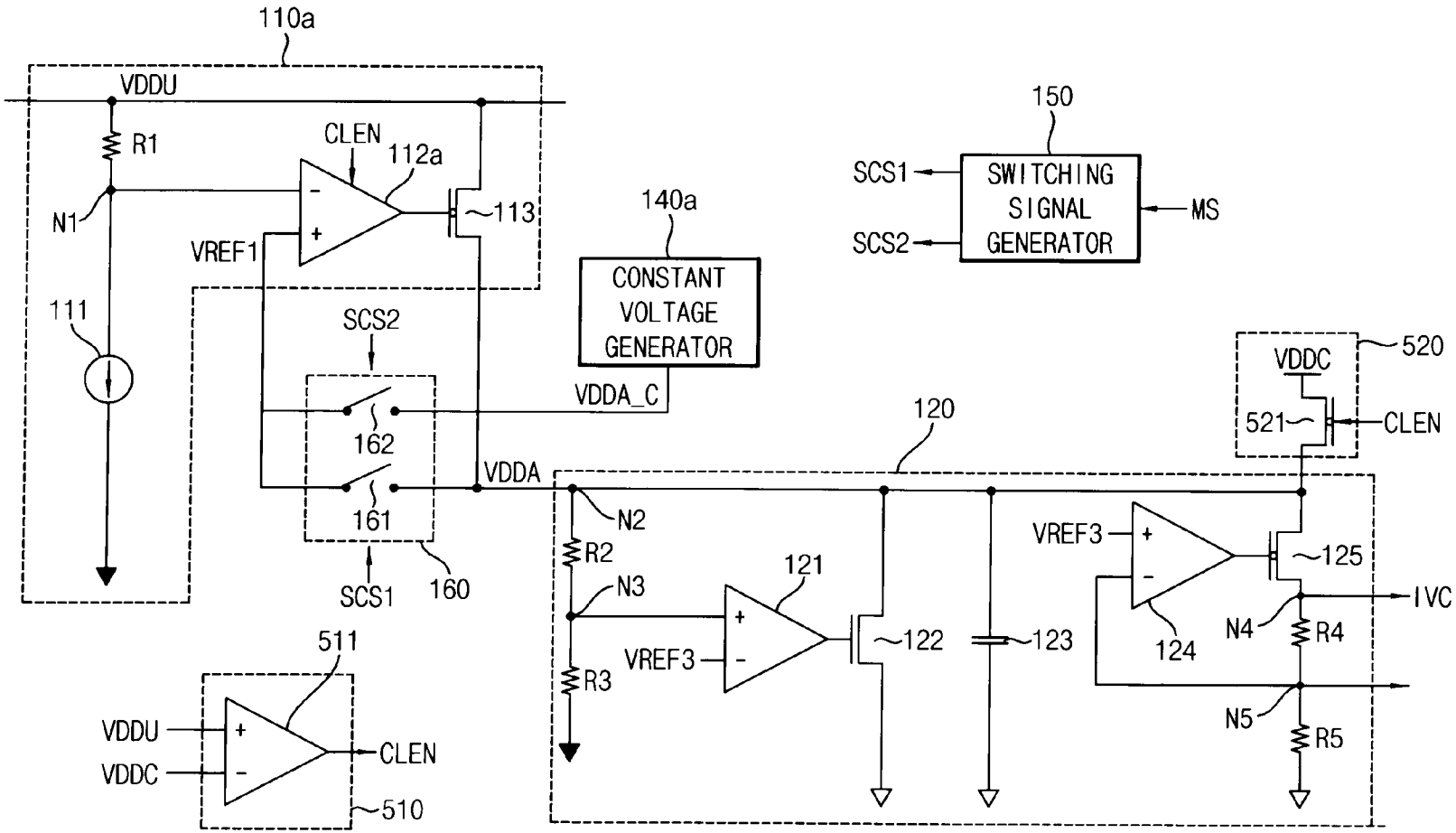
FIG. 14 is a block diagram illustrating an example of the internal voltage generator in FIG. 1 according to at least one example embodiment.

FIG. 14 is a block diagram illustrating an example of the internal voltage generator in FIG. 1 according to at least at least one example embodiment.

An internal voltage generator 500*a* may be used in the contactless IC card 10 which operates in two modes, that is, contact mode and contactless mode.

Referring to FIG. 14, the internal voltage generator 500*a* includes a mode decision unit 510, a regulator 110*a*, an internal voltage generating unit 120, a constant voltage generator 140*a*, a switching signal generator 150, a switching unit 160 and a contact voltage providing unit 520.

The mode decision unit 510 compares a contactless voltage (or, input voltage) VDDU and a contact voltage VDDC and outputs a contactless enable signal CLEN. When the contactless voltage VDDU is higher than the contact voltage VDDC, the contactless enable signal CLEN is activated to a high level. When the contactless voltage VDDU is lower than the contact voltage VDDC, the contactless enable signal CLEN is deactivated to a low level. The mode decision unit 510 may include a comparator 511 that compares the contactless voltage (or, input voltage) VDDU and the contact voltage VDDC and outputs the contactless enable signal CLEN.

The regulator 110*a* includes a current source 111, a first comparator 112*a*, a p-type metal-oxide semiconductor (PMOS) transistor 113 and a first resistor R1. The first comparator 112*a* compares a voltage of a first node N1 and the first reference voltage VREF1, and the first resistor R1 and the current source 111 are connected in series at the first node N1 between the input voltage VDDU and a ground voltage.

The PMOS transistor 113 may include a source connected to the input voltage VDDU, a drain connected to a second node N2, and a gate connected to an output of the first comparator 112*a*. The first node N1 is connected to a negative input terminal of the first comparator 112*a* and the first reference voltage VREF1 is connected to a positive input terminal of the first comparator 112*a*. The first comparator 112*a* may be selectively enabled in response to the contactless enable signal CLEN. When the contactless enable signal CLEN is activated, the first internal voltage VDDA is outputted at the first node N1.

A configuration of the internal voltage generating unit 120, the constant voltage generator 140*a* and the switching unit 160 are substantially the same as corresponding ones of the internal voltage generator 100*a* of FIG. 3, and thus a detailed description of these elements is omitted.

The contact voltage providing unit 520 may selectively provide the contact voltage VDDC in response to the contactless enable signal CLEN. The contact voltage providing unit 520 may include a PMOS transistor 521. A source of the PMOS transistor 521 is connected to the contact voltage VDDA, and a drain of the PMOS transistor 447 is connected to the second node N2. The contactless enable signal CLEN is provided to a gate of the PMOS transistor 521. When the contactless enable signal CLEN is activated to a high-level, the contact voltage VDDC is not provided to the second node N2, and the first internal voltage VDDA is provided to the second node N2. When the contactless enable signal CLEN is deactivated to a low-level, the contact voltage VDDC is provided to the second node N2. Therefore, when the contactless enable signal CLEN is activated to a high-level, the clock generator 200 may generate the clock signal CK based on the first internal voltage VDDA and the second internal voltage IVC. When the contactless enable signal CLEN is deactivated to a low-level, the clock generator 200 may receive the second internal voltage IVC, which is based on the contact voltage VDDC, to generate the clock signal CK.

When the contactless enable signal CLEN is deactivated to a low-level, the contact voltage VDDC is provided to the second node N2, and thus, the contact voltage VDDC may replace the first internal voltage VDDA in FIGS. 3 and 4.

Figure 15:
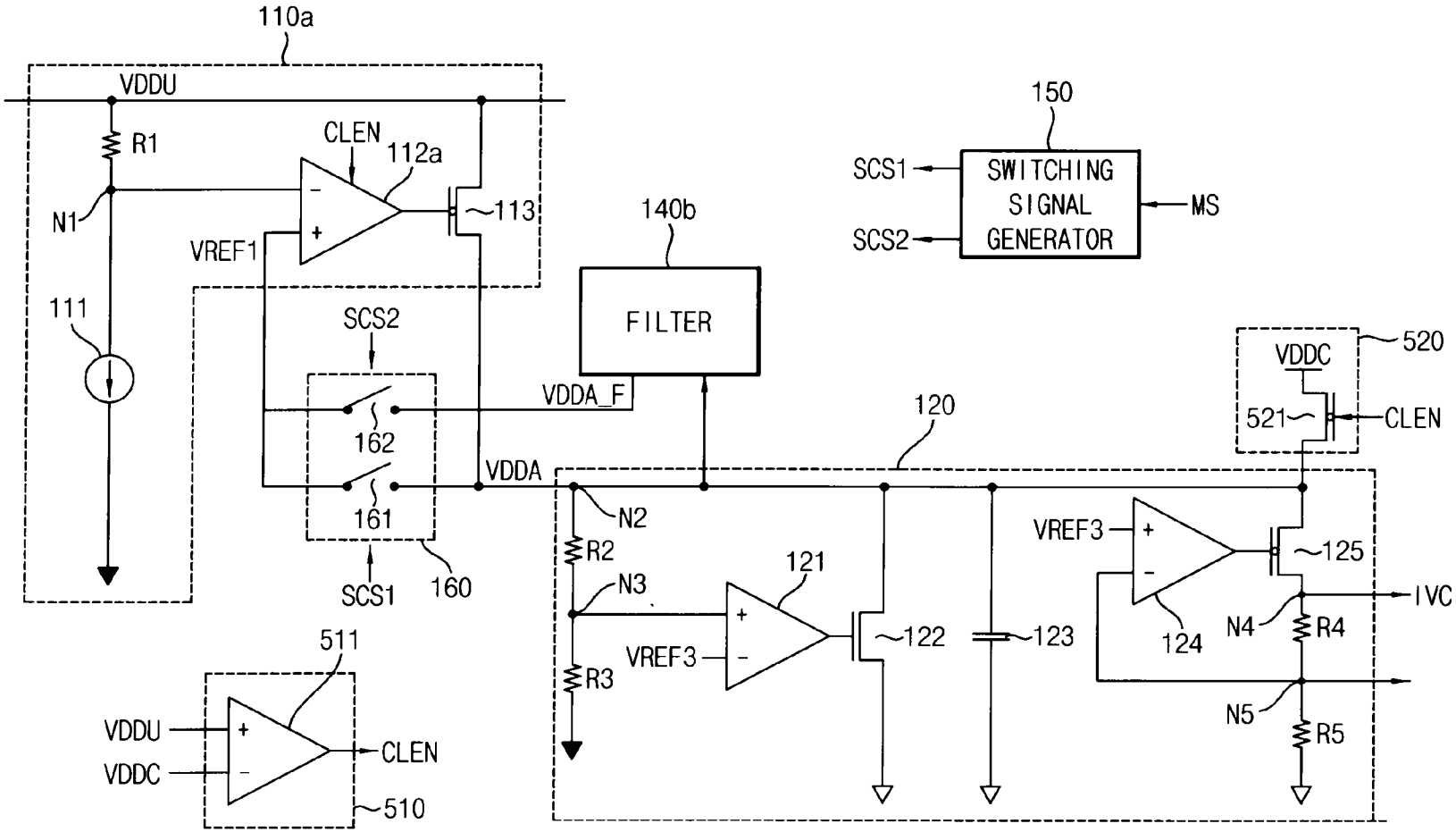
FIG. 15 is a block diagram illustrating another example of the internal voltage generator in FIG. 1 according to at least one example embodiment.

FIG. 15 is a block diagram illustrating another example of the internal voltage generator in FIG. 1 according to at least one example embodiment.

An internal voltage generator 500*b* may be used in the contactless IC card 10 which operates in two modes; a contact mode and a contactless mode.

Referring to FIG. 15, the internal voltage generator 500*b* includes a mode decision unit 510, a regulator 110*a*, an internal voltage generating unit 120, a filter 140*b*, a switching signal generator 150, a switching unit 160 and a contact voltage providing unit 520.

The internal voltage generator 500*b* of FIG. 15 differs from the internal voltage generator 500*a* of FIG. 14 in that the constant voltage generator 140*a* is replaced with the filter 140*b*, and thus, a detailed description on the internal voltage generator 500*b* of FIG. 15 is omitted.

Figure 16:
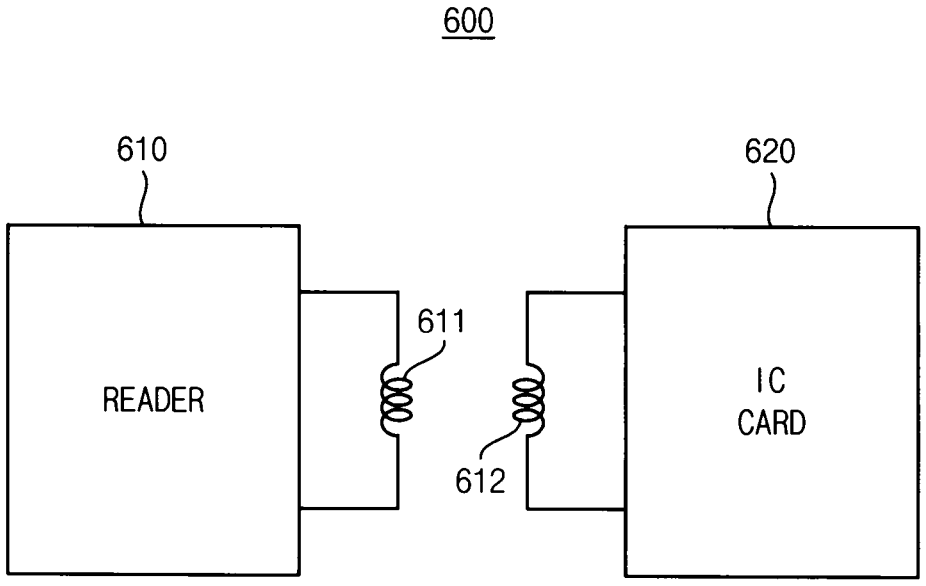
FIG. 16 is a diagram illustrating a contactless IC card system according to at least one example embodiment.

FIG. 16 is a diagram illustrating a contactless IC card system according to at least one example embodiment.

Referring to FIG. 16, a contactless IC card system 600 includes a contactless IC card reader 610, a contactless IC card 620, a first antenna 611 and a second antenna 612. The contactless IC card reader 610 and the contactless IC card 620 exchange data with each other through the first and second antennas 611 and 612. The contactless IC card 620 may receive a voltage from the first antenna 611 through the second antenna 612. The contactless IC card 620 may include the contactless IC card 10 of FIG. 1. Therefore, the contactless IC card 620 selects the reference voltage for the regulator in the internal voltage generator according to an operation mode that is determined based on whether the internal circuit performs an encryption operation. Thus, a fluctuation component is inhibited (or alternatively, prevented) from being transferred to the input voltage. Therefore, the contactless IC card 620 may reduce (or alternatively, prevent) transmission errors that may occur when the internal circuit performs an encryption operation.

Figure 17:
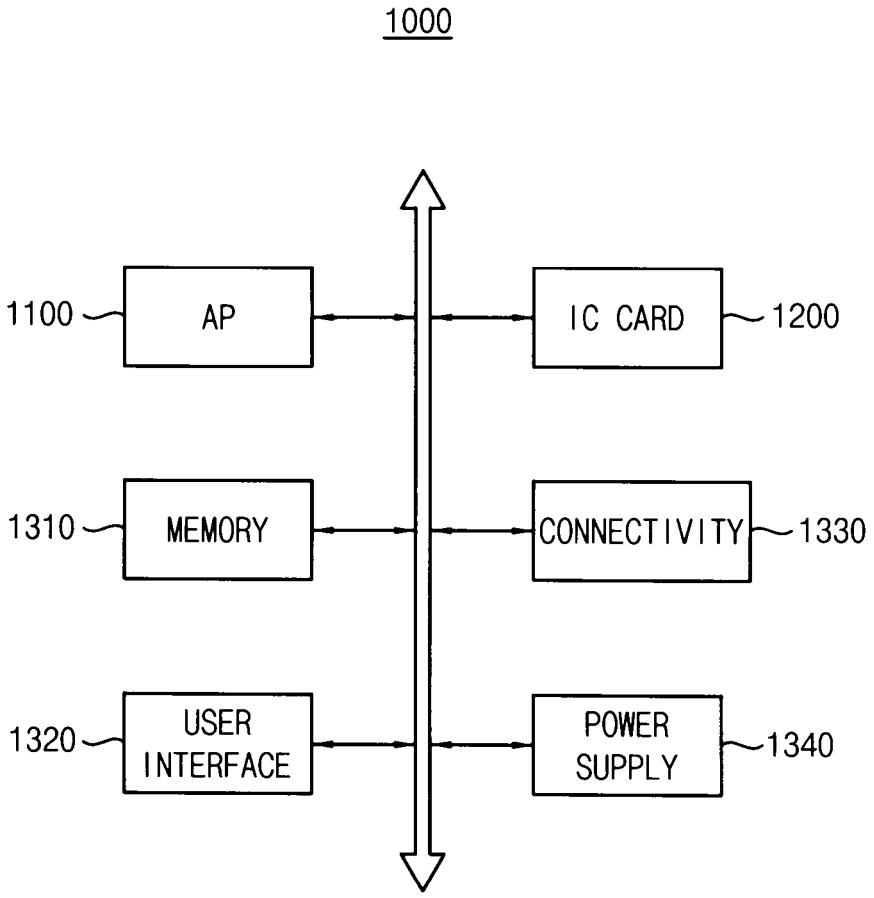
FIG. 17 is a block diagram illustrating a mobile system according to at least one example embodiment.

FIG. 17 is a block diagram illustrating a mobile system according to at least one example embodiment.

Referring to FIG. 17, a mobile system 1000 includes an application processor 1100, a contactless IC card 1200, a memory 1310, a user interface 1320, a connectivity unit 1330, and a power supply 1340. According to at least one example embodiment, the mobile system 1000 may be any mobile system, such as a mobile phone, a smart phone, a personal digital assistant (PDA), a portable multimedia player (PMP), a digital camera, a portable game console, a music player, a camcorder, a video player, a navigation system, etc.

The application processor 1100 may execute applications, such as a web browser, a game application, a video player, etc. In at least one example embodiment, the application processor 1100 may include a single core or multiple cores. For example, the application processor 1100 may be a multi-core processor, such as a dual-core processor, a quad-core processor, a hexa-core processor, etc. According to at least one example, the application processor 1110 may be coupled to an internal/external cache memory.

The memory device 1310 may store a boot image for booting the mobile system 1000, output data to be transmitted to an external device, and input data from the external device. For example, the memory device 1310 may be an electrically erasable programmable read-only memory (EEPROM), a flash memory, a phase change random access memory (PRAM), a resistance random access memory (RRAM), a nano floating gate memory (NFGM), a polymer random access memory (PoRAM), a magnetic random access memory (MRAM), a ferroelectric random access memory (FRAM), etc.

The contactless IC card 1200 selects the reference voltage for the regulator in the internal voltage generator according to operation mode that is determined based on whether the internal circuit performs an encryption operation. Thus, a fluctuation component is inhibited (or alternatively, prevented) from being transferred to the input voltage. Therefore, the contactless IC card 1200 may reduce (or alternatively) prevent transmission errors that may occur when the internal circuit performs encryption operation. The contactless IC card 1200 may employ the contactless IC card 10 of FIG. 1.

The user interface 1130 may include at least one input device, such as a keypad, a touch screen, etc., and at least one output device, such as a speaker, a display device, etc. The power supply 1340 may supply a power supply voltage to the mobile system 1000.

The connectivity unit 1330 may perform wired or wireless communication with an external device. For example, the connectivity unit 1330 may perform Ethernet communication, near field communication (NFC), radio frequency identification (RFID) communication, mobile telecommunication, memory card communication, universal serial bus (USB) communication, etc. In at least one example embodiment, connectivity unit 1330 may include a baseband chipset that supports communications, such as global system for mobile communications (GSM), general packet radio service (GPRS), wideband code division multiple access (WCDMA), high speed downlink/uplink packet access (HSxPA), etc.

In at least one example embodiment, the mobile system 1000 may further include a camera image processor (CIS), and/or a storage device, such as a memory card, a solid state drive (SSD), a hard disk drive (HDD), a CD-ROM, etc.

In at least one example embodiment, the mobile system 1000 and/or components of the mobile system 1000 may be packaged in various forms, such as package on package (PoP), ball grid arrays (BGAs), chip scale packages (CSPs), plastic leaded chip carrier (PLCC), plastic dual in-line package (PDIP), die in waffle pack, die in wafer form, chip on board (COB), ceramic dual in-line package (CERDIP), plastic metric quad flat pack (MQFP), thin quad flat pack (TQFP), small outline IC (SOIC), shrink small outline package (SSOP), thin small outline package (TSOP), system in package (SIP), multi-chip package (MCP), wafer-level fabricated package (WFP), or wafer-level processed stack package (WSP).

According to at least one example embodiment, the internal voltage generator and the contactless IC card may select the reference voltage to the regulator in the internal voltage generator according to operation mode that is determined based on current consumption, which may inhibit (or alternatively, prevent) the fluctuation component from being transferred to the input voltage. Thus, a contactless IC card according to at least one example embodiment may reduce (or alternatively, prevent) transmission errors that may occur when the internal circuit performs an encryption operation.

Various exemplary embodiments may be widely applicable to various contactless IC cards and card systems.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of inventive concepts. Accordingly, all such modifications are intended to be included within the scope of inventive concepts as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A voltage generator of a contactless integrated circuit (IC) card, the voltage generator comprising:

a regulator configured to generate a first internal voltage based on an input voltage and a first reference voltage, the input voltage being received through an antenna of the contactless IC card;

an internal voltage generator configured to generate a second internal voltage based on first internal voltage, the second internal voltage being used to operate an internal circuit of the contactless IC card;

a reference voltage generator configured to generate a second reference voltage based on the first internal voltage, the second reference voltage being generated without regard to a fluctuation component of the first internal voltage; and a switching unit, connected to the regulator, the internal voltage generator, and the reference voltage generator, configured to provide one of the first internal voltage and the second reference voltage as the first reference voltage in response to first and second switching control signals, the first and second switching control signals indicating an operation mode of the internal circuit.

2. The voltage generator of claim 1, further comprising:

a switching signal generator configured to, in response to a mode signal indicating the operation mode, generate the first and second switching control signals, and control activation intervals of the first and second switching control signals, the operation mode being based on current consumed in the internal circuit.

3. The voltage generator of claim 2, wherein, the activation intervals of the first and second switching control signals partially overlap, and the switching unit includes, a first switch connected between the internal voltage generator and the regulator, the first switch being configured to receive the first switching control signal, and a second switch connected between the reference voltage generator and the regulator, the second switch being configured to receive the second switching control signal.

4. The voltage generator of claim 1, wherein, the operation mode includes first and second operation modes according to the current consumed in the internal circuit, and a first current consumed in the first operation mode is less than a second current consumed in the second operation mode.

5. The voltage generator of claim 4, wherein, the first internal voltage is applied as the first reference voltage in response to the first switching control signal in the first operation mode, and the second reference voltage is applied as the first reference voltage in response to the second switching control signal in the second operation mode.

6. The voltage generator of claim 4, wherein the internal circuit performs at least one encryption operation in the second operation mode.

7. The voltage generator of claim 1, wherein the reference voltage generator includes a filter configured to filter the fluctuation component of the first internal voltage to generate the first reference voltage.

8. The voltage generator of claim 7, wherein the filter is a low-pass filter.

9. The voltage generator of claim 1, wherein the reference voltage generator includes a constant voltage generator configured to remove the fluctuation component of the first internal voltage by generating a constant voltage having a fixed level as the first reference voltage.

10. The voltage generator of claim 1, wherein the regulator comprises:

a first comparator configured to compare a voltage of a first node and The first reference voltage;

a current source;

a first resistor connected in series with the current source between the input voltage and a ground voltage, the first node being at a connection point between the first resistor and the current source; and a first p-channel metal-oxide semiconductor (PMOS) transistor connected between the input voltage at a second node to which the first internal voltage is provided, the first PMOS transistor having a gate connected to an output of the first comparator.

11. The voltage generator of claim 10, wherein the internal voltage generator comprises:

a second comparator configured to compare a voltage of a third node and a third reference voltage, the voltage of the third node being the first internal voltage divided by resistances of second and third resistors, the second and third resistors being connected in series between the second node and the ground voltage;

a n-channel metal-oxide semiconductor (NMOS) transistor connected between the second node and the ground voltage, the NMOS transistor having a gate connected to an output of the second comparator;

a second PMOS transistor connected between the second node and a fourth node, the second internal voltage being provided at the fourth node; and a third comparator configured to compare a voltage of a fifth node and the third reference voltage, the voltage of the fifth node being the second internal voltage divided by resistances of fourth and fifth resistors, the fourth and fifth resistors being connected in series between the fourth node and the ground voltage.

12. A contactless integrated circuit (IC) card, comprising:

a voltage generator configured to generate a first internal voltage and a second internal voltage based on an input voltage received through an antenna of the contactless IC card, the second internal voltage having a level that is less than a level of the first internal voltage;

an internal circuit configured to receive the second internal voltage and operate according to the second internal voltage; and a detector configured to detect a current consumed in the internal circuit and send a mode signal to the voltage generator based on the detected current, wherein the voltage generator includes, a regulator configured to generate the first internal voltage based on the input voltage and a first reference voltage, an internal voltage generator configured to generate the second internal voltage based on the first internal voltage such that the second internal voltage is less than the first internal voltage, a reference voltage generator configured to generate a second reference voltage based on the first internal voltage, the second reference voltage being generated without regard to a fluctuation component of the first internal voltage, and a switching unit, connected to the regulator, the internal voltage generator, and the reference voltage generator, configured to apply one of the first internal voltage and the second reference voltage as the first reference voltage in response to first and second switching control signals, the first and second switching control signals being based on the mode signal, the mode signal indicating an operation mode of the internal circuit.

13. The contactless IC card of claim 12, further comprising:

a demodulator configured to demodulate input data and send the demodulated input data to the internal circuit, the input data being received through the antenna; and a modulator configured to modulate output data from the internal circuit and send the modulated output data to the antenna, wherein the operation mode includes a first operation mode in which the modulator and the demodulator operate and a second operation mode in which the internal circuit performs at least one encryption operation.

14. The contactless IC card of claim 13, wherein, a first current consumed in the first operation mode is less than a second current consumed in the second operation mode, the first internal voltage is used as the first reference voltage in response to the first switching control signal in the first operation mode, and the second reference voltage is used as the first reference voltage in response to the second switching control signal in the second operation mode.

15. The contactless IC card of claim 12, wherein the reference voltage generator includes a filter configured to filter the fluctuation component of the first internal voltage to generate the first reference voltage.

* * * * *